US009839303B2

(12) United States Patent
Franzone, Jr.

(10) Patent No.: US 9,839,303 B2
(45) Date of Patent: Dec. 12, 2017

(54) ELONGATED PACKAGE DISPLAY DEVICE

(71) Applicant: Allen Field Company, Inc., Brightwaters, NY (US)

(72) Inventor: Andrew Franzone, Jr., West Islip, NY (US)

(73) Assignee: ALLEN FIELD COMPANY, INC., Brightwaters, NY (US)

( * ) Notice: Subject to any disclaimer, the term of this patent is extended or adjusted under 35 U.S.C. 154(b) by 0 days.

(21) Appl. No.: 15/227,525

(22) Filed: Aug. 3, 2016

(65) Prior Publication Data

US 2017/0065103 A1 Mar. 9, 2017

Related U.S. Application Data

(60) Provisional application No. 62/215,435, filed on Sep. 8, 2015.

(51) Int. Cl.
*A47F 5/00* (2006.01)

(52) U.S. Cl.
CPC .... *A47F 5/0006* (2013.01); *A47F 2005/0012* (2013.01)

(58) Field of Classification Search
CPC .. A47F 5/0006; A47F 7/28; A47F 5/04; A47F 2005/0012; A47F 5/0884; B65D 75/566; B65D 2575/565; B65D 73/0028; B65D 73/0064; Y10S 206/806; G09F 3/16; G09F 3/08; G09F 1/103
USPC ..... 211/85.15, 113, 73, 89.01, 72, 120, 211/85.29, 85.26, 59.2; 206/482, 806, 206/493, 466; 248/220.41, 220.31, 248/222.12, 225.11, 99, 100, 339, 250; 40/657
See application file for complete search history.

(56) References Cited

U.S. PATENT DOCUMENTS 436,600 A * 9/1890 Hartman ..... G09F 1/10 211/87.01
2,116,386 A * 5/1938 Copeland ..... A47F 7/143 211/120
4,461,387 A * 7/1984 Belokin, Jr. ..... A47F 5/04 211/194
4,573,590 A * 3/1986 Ellis ..... A47F 5/0068 211/118
4,767,012 A * 8/1988 Simmons ..... A47F 5/0884 211/113

(Continued)

*Primary Examiner* — Stanton L Krycinski
*Assistant Examiner* — Hiwot Tefera
(74) *Attorney, Agent, or Firm* — Epstein Drangel LLP; Robert L. Epstein

(57) ABSTRACT

The device is designed to be suspended from a rack to display multiple packaged products. It includes an elongated flexible plastic body with multiple, uniformly spaced truncated elongated pyramid-like raised portions. The raised portions have top surfaces. An opening in each top surface is defined in part by an edge. A member with an unattached end portion extends from the edge, in alignment with the opening. The unattached edge portion of the member is spaced from the top surface. The member end is adapted to be received within an opening in a product package such that the package is supported by the device in a manner which provides easy loading of the device at the factory, efficient shipping of the loaded device to a retail establishment, easy removal of one or more packages from the device and in which at least a portion of each displayed package is visible.

12 Claims, 5 Drawing Sheets

(56) References Cited

U.S. PATENT DOCUMENTS

| | | | | | |
|---|---|---|---|---|---|
| 5,199,578 | A * | 4/1993 | Pendergraph | A47F 5/0006 | 206/482 |
| 5,386,916 | A * | 2/1995 | Valiulis | A47F 5/0006 | 211/113 |
| 5,906,346 | A * | 5/1999 | Lin | F16B 5/02 | 248/224.8 |
| 5,927,496 | A * | 7/1999 | Seaton | B65D 21/0235 | 206/461 |
| 5,957,422 | A * | 9/1999 | Shea | A47F 5/0807 | 211/87.01 |
| 5,967,341 | A * | 10/1999 | Werner | A47F 5/0884 | 211/71.01 |
| 6,286,690 | B1 * | 9/2001 | Thalenfeld | A47F 5/0006 | 211/113 |
| 6,966,446 | B1 * | 11/2005 | Wise | A47F 5/0006 | 206/806 |
| 7,429,024 | B2 * | 9/2008 | Boklund-Moran | A47G 29/083 | 16/429 |
| 2010/0065712 | A1 * | 3/2010 | Vanwitzenberg | A47G 25/06 | 248/610 |

* cited by examiner

ELONGATED PACKAGE DISPLAY DEVICE

CROSS-REFERENCE TO RELATED APPLICATIONS

Priority is claimed on Provisional Patent Application No. 62/215,435, filed Sep. 8, 2015, the contents of which are incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to a device designed for use by retail establishments to display multiple product packages on a display rack and more particularly to such a device with increased capacity which allows for quick and easy loading of the packages at the factory, is flexible enough to be folded with the loaded packages for efficient shipping, can be quickly mounted on a display rack as a unit at the retail establishment and allows individual or groups of packages to be easily removed by a purchaser.

2. Description of Prior Art Including Information Disclosed Under 37 CFR 1.97 and 1.98

Many different types of racks for displaying packaged products are known and used in retail establishments. One common type of display rack includes a free standing base with upstanding central member from which one or more horizontal support rods extend. That type of rack is particularly well suited for displaying products packaged in rigid containers made of plastic, cardboard or combinations thereof, or in bags formed of flexible plastic sheets, with or without cardboard headers. Such packages are provided with openings in the upper portion thereof. The openings are designed to receive the support rods to suspend the packages from the rack. Each of the rods is capable of supporting multiple packages which hang from the rod in parallel relation along the length of the rod.

The packages are shipped to the retail establishment individually in a box. At the retail establishment, the packages are removed from the box and loaded one at a time onto the display rack by an employee of the retail establishment in a process which is labor intensive and time consuming.

After loading of the rack, the packages hang in alignment along the support rod of the display rack such that only the first or outermost package is visible. The other packages are completely or partially hidden from the view of a potential purchaser by the first or outermost package on the rod.

A purchaser that desires to obtain one or more of the displayed products from the loaded rack removes one or more of the packages from the support rod starting with the first or outer most package. The individual packages can move freely along the length of the support rod and tend to bunch up on the rod making it difficult for a prospective purchaser to remove a single package, or a specific number of packages, at one time.

Accordingly, loading display racks of this type in the conventional manner at the retail establishment is difficult and time consuming for retail establishment personnel. Once loaded, the packages may be difficult for a potential purchaser to see and are difficult to remove from the rack individually or in groups.

The present invention overcomes these disadvantages by employing an elongated, high capacity device for use with a display rack configured to allow packages to be easily and quickly loaded on the display device at the factory and shipped to the retail establishment fully loaded as a unit. The device is flexible enough to allow the unit be folded in half for efficient shipping. At the retail establishment, the unit can be easily suspended on a display rack by retail establishment personnel. The packages are retained on the device at different levels which allows at least a portion of each package to be seen by a prospective purchaser and facilitates removal of individual packages or groups of packages from the device by a prospective purchaser.

Other types of display racks include an upstanding wall, often made of corrugated material. The top of the wall has a horizontal edge from which product packages of various configurations can be hung. Since that type of rack has no support rods, a different structure is required for the packages to engage the display wall, other than a simple opening in the package as with the support rod type rack. Accordingly, it would be desirable to have a single device which could be used to display products on display racks that have either support rods or upstanding walls. The present invention addresses that problem by providing the device with a additional part designed to engage the wall of the rack.

It is, therefore, a prime object of the present invention to provide a device for use on a display rack capable of displaying multiple product packages which is easy and requires less time to load with multiple product packages at the factory.

It is another object of the present invention to provide a display device which is flexible enough to be folded in half when loaded such that the device and packages can be efficiently shipped to the retail establishment as a unit.

It is another object of the present invention to provide a pre-loaded display device which can easily and quickly be mounted on a display rack by retail establishment personnel.

It is another object of the present invention to provide a display device wherein one or more packaged products can be easily removed from the rack by a potential purchaser.

It is another object of the present invention to provide a display device in which at least a portion of each displayed product package is visible to a prospective purchaser.

It is another object of the present invention to provide a display device with an elongated body such that each product package is situated at a different level.

It is another object of the present invention to provide a display device in which product packages are suspended from individual members which extend outwardly from the device.

It is another object of the present invention to provide a single display device capable of being used with displays that include either support rods or upstanding walls.

It is another object of the present invention to provide a display device for use with a plurality of packaged product that is inexpensive to fabricate.

It is another object of the present invention to provide a display device that is made of a single piece of plastic material.

It is another object of the present invention to provide a display device made of plastic fabricated by well-known techniques on commercially available equipment.

It is another object of the present invention to provide a product display device designed to be strong enough for repeated use but inexpensive enough to be disposable.

BRIEF SUMMARY OF THE INVENTION

To those and such other objects which may hereinafter appear, the present invention is directed to a device for displaying a product package of the type having an opening therein. The device includes an elongated body having a surface situated in a plane. An opening in the surface is defined in part by an edge. A member with an unattached end portion extends from the edge, in alignment with the opening. The unattached edge portion of the member is spaced from the plane of the surface. The member is adapted to be received within the package opening such that the package is supported by the device.

The product engaging member has first and second sides. The member is arcuate when viewed from the side.

First and second protrusions extend outwardly in opposite directions from the sides of the member. The protrusions serve to properly position a product package on the member.

The device includes at least one truncated elongated pyramid-like raised portion. The surface opening is situated in the top surface of the raised portion. The raised portion includes two sets of spaced, oppositely inclined side surfaces. Preferably, multiple raised portions are situated along the body of the device in uniform spaced relation.

The surface opening has a first section adjacent the edge from which the member extends and a second section spaced from that edge. Preferably, the first section of the surface opening is wider than the second section and is aligned with the protrusions extending from the member from which the packages are suspended.

The upper portion of the device also includes an opening designed to receive a support rod of a display rack in order to mount the device on the rack. The upper portion of the device is wider than the remainder of the device.

The device is also suitable for use with a display rack of the type having an upstanding wall. For that purpose, a part which extends from the rear surface is provided. The part has a portion which is substantially parallel to and spaced from the rear surface of the device. The part defines a recess adapted to receive the upper portion of the upstanding wall of the rack in order to suspend the device.

In accordance with another aspect of the present invention, a device is provided for displaying a plurality of product packages. Each package is provided with an opening. The device includes an elongated body having a plurality of surfaces. Each of the surfaces is situated in a plane. An opening is situated in each of the surfaces. Each of the surface openings is defined in part by an edge. A member extends from the edge of each surface openings in alignment with the surface opening. Each of the members has an unattached end at least partially situated in a location spaced from the plane of the surface. Each of the members is adapted to be received within the opening in a different one of the packages such that the packages are supported by the device.

Each of the members has at least one protrusion extending from the side thereof. The protrusion is situated proximate to the attached end of the member.

The device includes a plurality of raised portions situated in spaced relation along the length of the device. Each raised portion includes a top surface and at least one inclined side. Preferably, each raised portion includes two sets of spaced, oppositely inclined side surfaces.

Each of the surface openings includes a first section adjacent the edge from which a member extends and a second section spaced from the edge. The first section is wider than the second section to accommodate the protrusion extending from the member.

The top surfaces of the raised portions are preferably located in the same plane. The device has an end. The end is wider than the remainder of the device.

The device is adapted for use with a display rack of the type having a support rod. The support rod is adapted to be received within the opening of at least one of the packages.

In accordance with another aspect of the present invention, a display rack of the type having a support rod and a device for displaying a product package of the type having an opening are provided in combination. The device includes an elongated body having a surface situated in a plane. An opening is present in the body surface. The surface opening is defined in part by an edge. A member extends from the edge of the opening in alignment with the opening. A member having an unattached end is provided. The unattached end is at least partially situated in a location spaced from the plane of surface. The member is adapted to be received within the package opening such that the package is supported by the device. The device has an opening therein adapted to receive the support rod of the rack to mount the device on the rack.

BRIEF DESCRIPTION OF THE SEVERAL VIEWS OF DRAWINGS

DETAILED DESCRIPTION OF THE INVENTION

Figure 1:
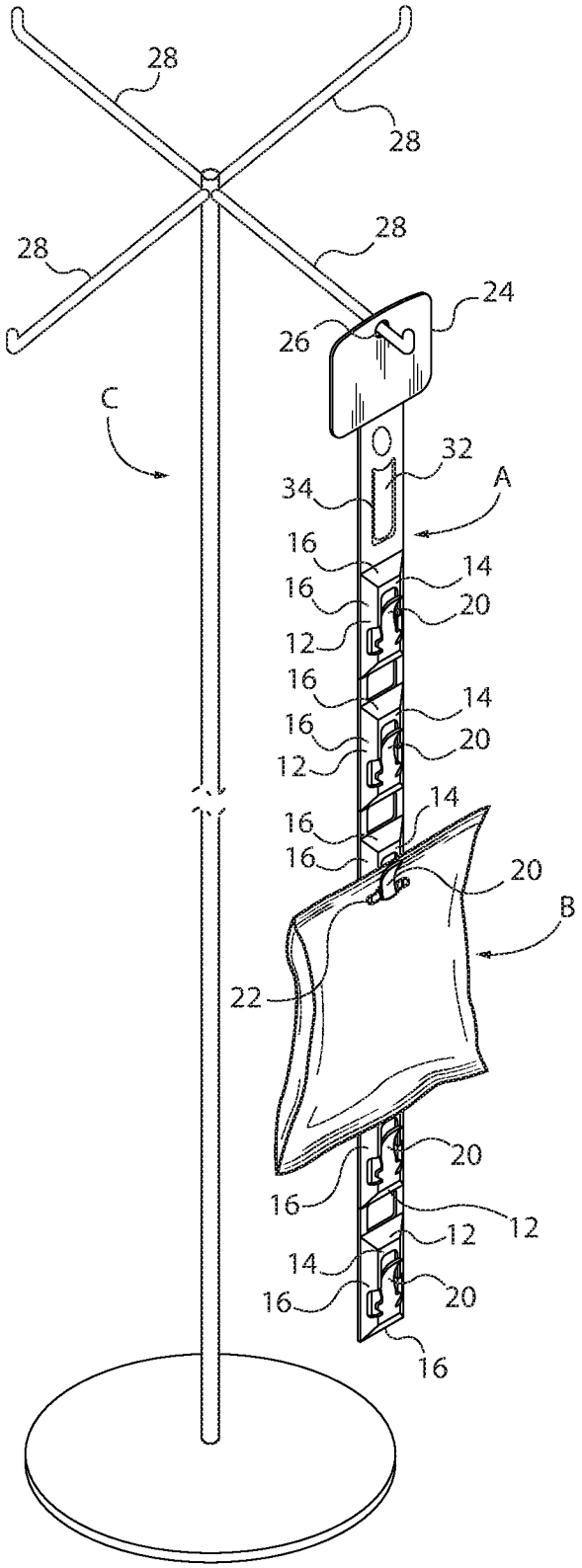
FIG. 1 is a perspective view of the display device of the present invention as it would appear mounted on the support rod of a display rack, with a product package suspended from the device.
Figure 2:
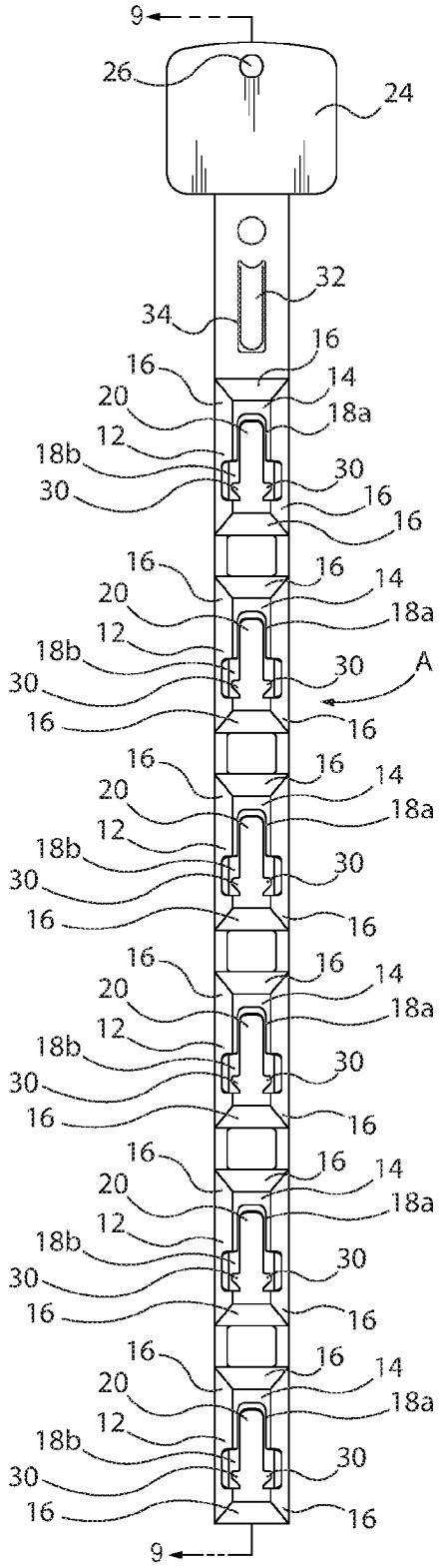
FIG. 2 is a front elevation view of the display device.
Figure 3:
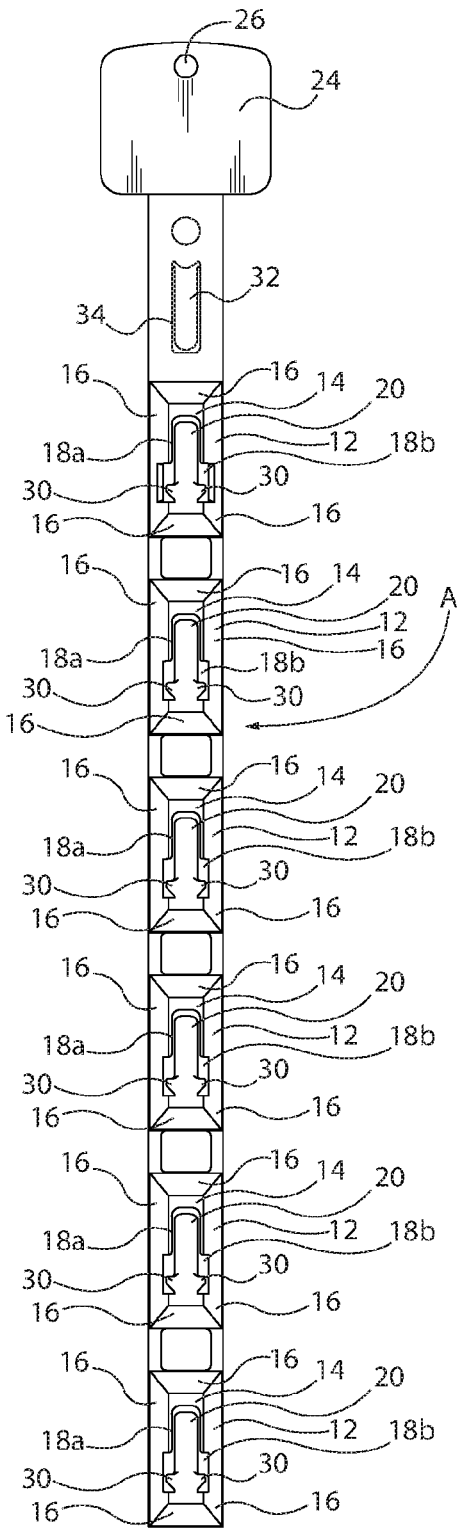
FIG. 3 is a rear elevation view of the display device.

The present invention relates to a device for displaying product packages. The device includes an elongated body, generally designated A, which retail establishments use to display multiple packaged products, generally designated B, such as packages of potato chips, from a display rack, generally designated C.

Body A is preferably formed of a single piece of stamped or molded plastic, using conventional fabrication techniques and equipment. The plastic material and cross-sectional shape of the device make the device flexible enough to be folded for efficient shipping and at the same time strong enough to be used repeatedly. However, the device can be manufactured inexpensively enough to be disposable.

The device includes a series of integral raised portions 12 uniformly spaced along the length of the device. Preferably, each of the raised portions 12 has a truncated elongated pyramid-like shape and includes a substantially planar top surface 14 and two sets of outwardly inclined opposing side surfaces 16. The top surface 14 of each of the raised portions 12 is situated in a plane which is spaced from the plane of the device body. Preferably, top surfaces 14 are co-planar.

The top surface 14 of each raised portion 12 has an opening 18 therein. Each opening 18 includes a narrow portion 18*a* and a wide portion 18*b*.

Figure 4:
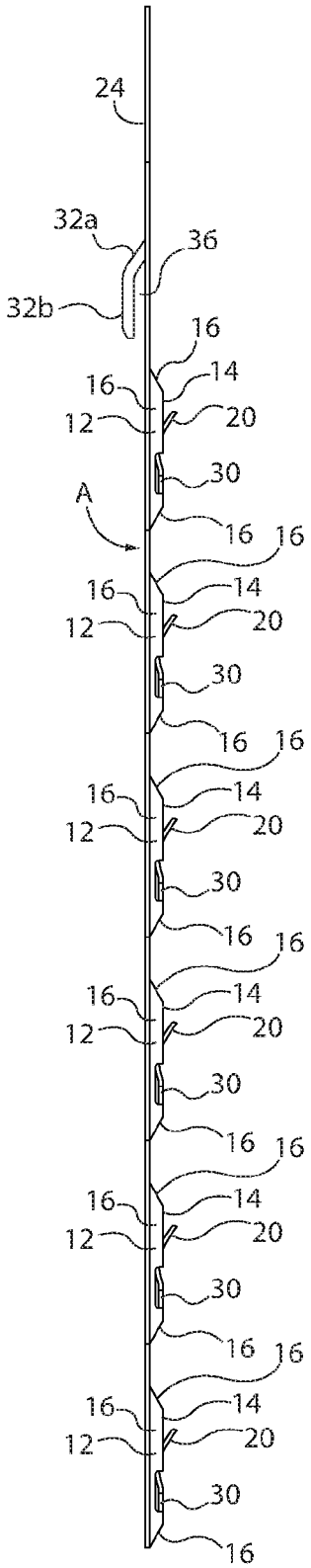
FIG. 4 is an elevation view of one side of the display device.
Figure 5:
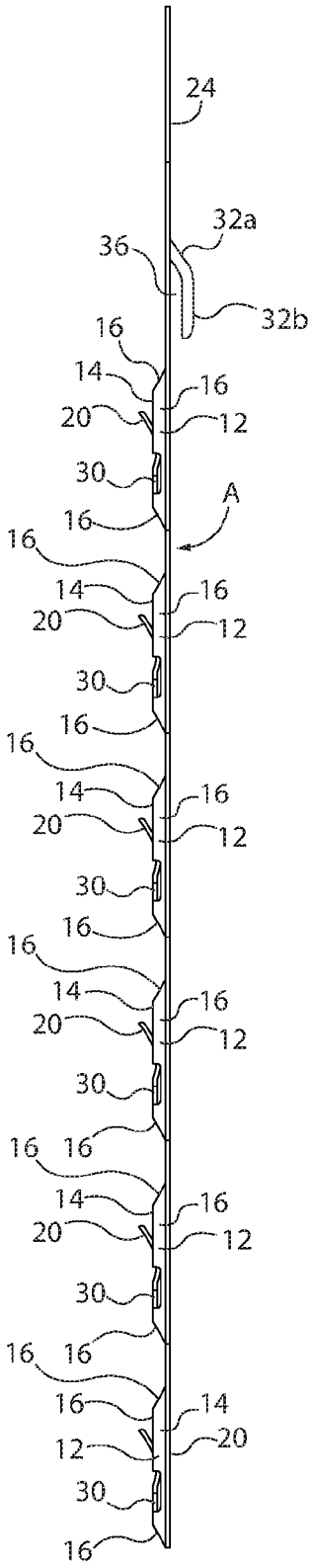
FIG. 5 is an elevation view of the other side of the display device.
Figure 6:
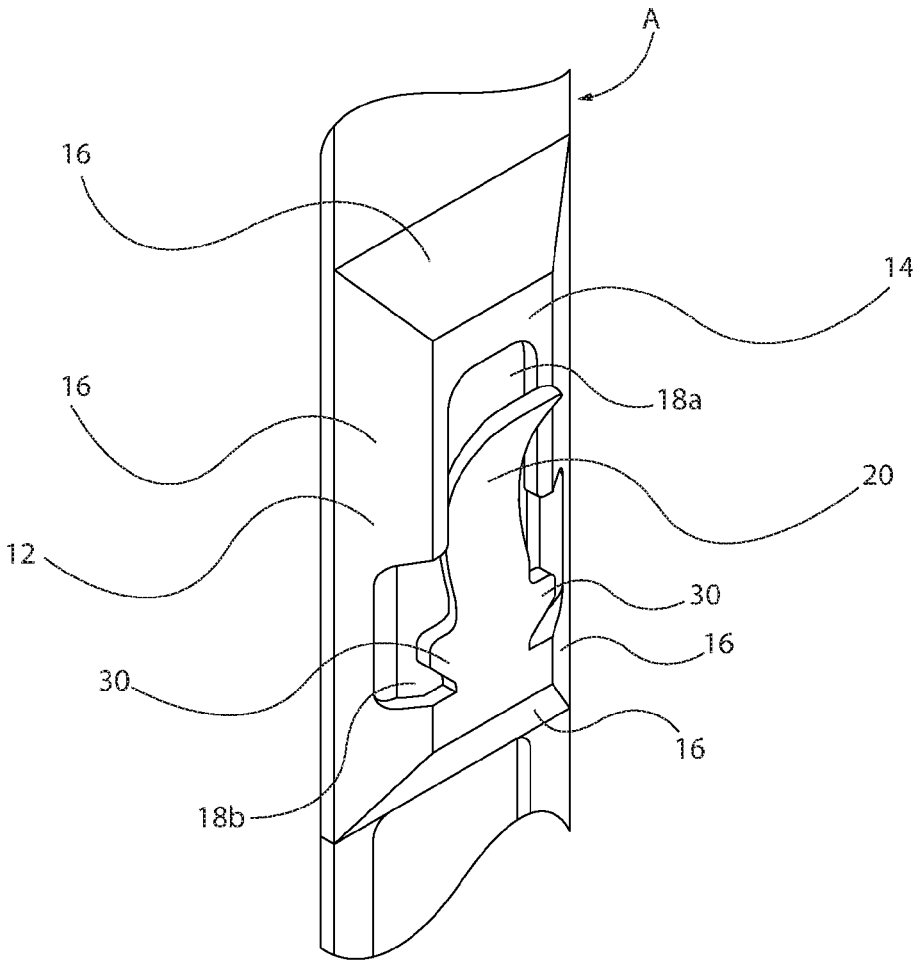
FIG. 6 is an enlarged perspective view of one of the raised portions of the device.
Figure 7:
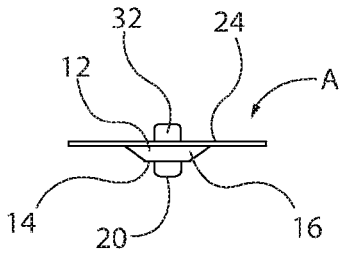
FIG. 7 is a top plan view of the display device.
Figure 8:
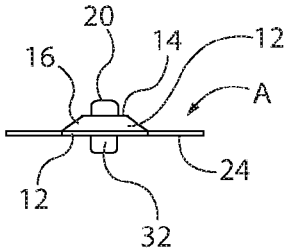
FIG. 8 is a bottom plan view of the display device.
Figure 9:
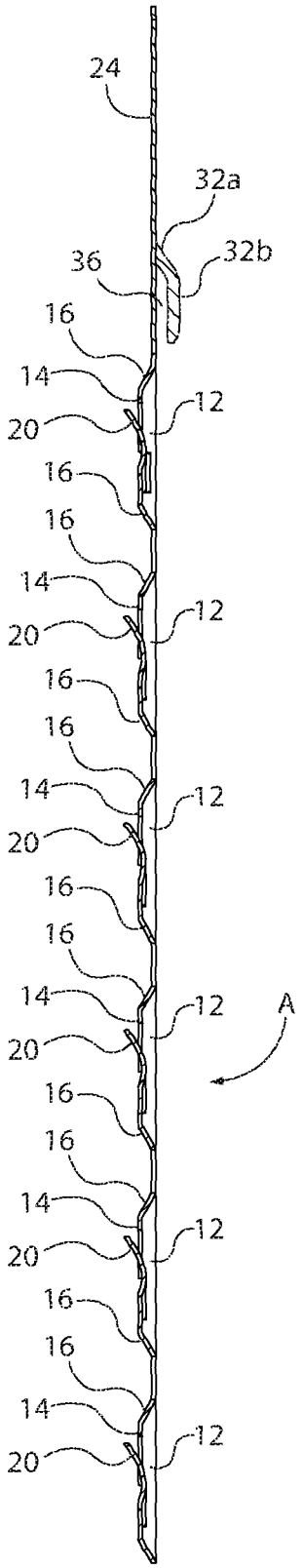
FIG. 9 is a cross-sectional view of the display device taken along line 9-9 of FIG. 2.

As is clear from FIGS. 4, 5 and 6, body A is not planar. The raised portions, with their inclined sides and planar top surfaces, add strength to the device without additional material or weight.

Aligned with each opening 18 is an arcuate member 20 which extends outwardly from the edge of the opening 18 and is integral with body A. Because of the curved shape of members 20, the unattached end of each member is situated in a plane which is spaced from the plane of the top surface 14 from which it extends, as best seen in FIG. 6. Each member 20 is adapted to engage an opening 22 in a different one of the product packages B being displayed.

The raised portions with the outwardly extending unattached ends of the package engaging members and align openings allow for easy loading of the device with product packages and easy removal of the product packages, as compared to conventional display devices fabricated in a single plane. Further, the vertical orientation of the device with spaced package engaging members situated at different levels assures that at least a portion of each product package is always visible to a prospective purchaser.

Each package engaging member 20 includes first and second integral protrusions 30 outwardly extending in different directions from the sides thereof. The protrusions serve to properly position a product package on the member.

Protrusions 30, and the portion of member 20 therebetween, align with the wide portion 18*b* of opening 18. The unattached end of the member aligns with the narrow portion 18*a* of opening 18.

The body A has an enlarged, generally rectangular-shaped upper portion 24 with a round hole 26. Hole 26 is designed to receive a support rod 28 extending from display rack C such that the device may hang from the display rack, as illustrated in FIG. 1.

The device also has a part 32 aligned with an opening 34 situated proximate the enlarged upper portion 24 of body A. As best seen in FIGS. 4, 5, 7 and 8, part 32 extends outwardly and downwardly from the rear surface of body A.

Part 32 includes an inclined portion 32*a* and a portion 32*b*. Portion 32*a* is situated between the device and portion 32*b*. Portion 32*b* is substantially parallel to but spaced from the rear surface of the body. Part 32 and the rear surface of the body together form a recess 36. Recess 36 is adapted to receive the upper portion of the upstanding wall of a display to suspend the device. This configuration allows the device to be used with display rack having a support rod, as illustrated in FIG. 1, and with displays with upstanding walls, without modification.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A device for displaying a product package of the type having an opening therein, said device comprising an elongated body having a top and a surface situated in a plane, a truncated pyramid shaped portion unitary with said surface of the body and having a surface situated in a plane substantially parallel to and spaced from said surface of the body, said surface of the truncated pyramid shaped portion having an opening defined in part by an edge, a member extending from said edge toward said top of said body in alignment with said opening, said member having an unattached end curved outwardly relative to said surface of the truncated pyramid shaped portion in order to facilitate said member being received in the package opening such that the package is supported by said device.

2. The device of claim 1 further comprising a protrusion outwardly extending from said member at a location remote from said unattached end.

3. The device of claim 1 further comprising first and second protrusions outwardly extending from said member at a location remote from said unattached end.

4. The device of claim 1 adapted for use with an upstanding wall, wherein said body has a second surface, opposite to and substantially parallel to said surface of the body, and further comprising a part extending from said second surface and defining a recess adapted to receive a portion of the wall.

5. A device for displaying a plurality of product packages of the type having an opening therein, said device comprising an elongated body having a top and a surface situated in a plane, a series of spaced truncated pyramid shaped portions unitary with said body, each of said portions comprising a surface situated in a plane substantially parallel to and spaced from said surface of the body, said surface of each truncated pyramid shaped portion having an opening defined in part by an edge, and a member extending from said edge toward the top of said body in alignment with said opening, said member having an unattached end curved outwardly relative to said surface of the respective truncated pyramid shaped portion in order to facilitate said member being received in the package opening such that the package is supported by said device.

6. The device of claim 5 wherein each of said members comprises a protrusion outwardly extending from said member at a location remote from said unattached end.

7. The device of claim 5 wherein each of said members comprises first and second protrusions outwardly extending from said member at a location remote from said unattached end.

8. The device of claim 5 adapted for use with an upstanding wall, wherein said body has a second surface, opposite to and substantially parallel to said surface of the body, and further comprising a part extending from said second surface and defining a recess adapted to receive a portion of the wall.

9. In combination, a display rack of the type having a support rod and a device for engaging said rod and for displaying a product package of the type having an opening therein, said device comprising an elongated body having a surface situated in a plane, an truncated pyramid shaped portion having a surface situated in a plane substantially parallel to and spaced from said surface of the body, said surface of the truncated pyramid shaped portion having an opening defined in part by an edge, a member extending from said edge in alignment with said opening, said member having an unattached end curved outwardly relative to said surface of the truncated pyramid shaped portion in order to facilitate said member being received in the package opening such that the package is supported by said device.

10. In combination, a display rack of the type having a support rod and a device for engaging said rod and for displaying a plurality of product packages of the type having an opening therein, said device comprising an elongated body having a surface situated in a plane, a series of spaced truncated pyramid shaped portions, each of said portions comprising a surface situated in a plane substantially parallel to and spaced from said surface of the body, said surface of each truncated pyramid shaped portion having an opening defined in part by an edge, and a member extending, from said edge in alignment with said opening, said member having an unattached end curved outwardly relative to said surface of the respective truncated pyramid shaped portion in order to facilitate said member being received in the package opening such that the package is supported by said device.

11. A device for displaying a product package of the type having an opening therein, said device comprising an elongated body having, a surface situated in a plane, a truncated pyramid shaped portion having a surface situated in a plane substantially parallel to and spaced from said surface of the body, said surface of the truncated pyramid shaped portion having an opening defined in part by an edge, a member extending from said edge in alignment with said opening, said member having an unattached end curved outwardly relative to said surface of the truncated pyramid shaped portion in order to facilitate said member being received in the package opening such that the package is supported by said device, further comprising first and second protrusions outwardly extending from said member at a location remote from said unattached end.

12. A device for displaying a plurality of product packages of the type having an opening therein, said device comprising an elongated body having a surface situated in a plane, a series of spaced truncated pyramid shaped portions each of said portions comprising a surface situated in a plane substantially parallel to and spaced from said surface of the body, said surface of each truncated pyramid shaped portion having an opening defined in part by an edge, and a member extending from said edge in alignment with said opening, said member having an unattached end curved outwardly relative to said surface of the respective truncated pyramid shaped portion in order to facilitate said member being received in the package opening such that the package is supported by said device, wherein each of said members comprises first and second protrusions outwardly extending from said member at a location remote from said unattached end.

* * * * *